US010806194B1

(12) United States Patent
Tyson

(10) Patent No.: US 10,806,194 B1
(45) Date of Patent: Oct. 20, 2020

(54) BEAUTY GLOVES

(71) Applicant: Joshua Tyson, New York, NY (US)

(72) Inventor: Joshua Tyson, New York, NY (US)

( * ) Notice: Subject to any disclaimer, the term of this patent is extended or adjusted under 35 U.S.C. 154(b) by 0 days.

(21) Appl. No.: 16/873,108

(22) Filed: Jan. 31, 2020

(51) Int. Cl.
*A41D 19/00* (2006.01)
*A45D 44/00* (2006.01)
*A41D 27/20* (2006.01)

(52) U.S. Cl.
CPC ..... *A41D 19/0037* (2013.01); *A41D 19/0024* (2013.01); *A45D 44/00* (2013.01)

(58) Field of Classification Search
CPC ..... A45F 2005/008; A45F 5/00; A45F 5/02; A45F 2200/0575; A45F 2200/0516; A45C 13/02; A45C 11/008; A45C 15/04; A45C 15/00; A45C 11/18; A45C 13/023; A45C 1/08; A45C 2011/003; A45C 5/06; A45C 11/00; A45C 11/32; A45C 13/001; A45C 13/1069; A45C 13/18; A45C 2011/007; A45C 2013/026; A45C 2013/1015; A45C 7/0045; A45C 7/005; A45C 7/0054; A41D 19/002; A41D 19/0024; A41D 19/0037; A41D 19/01594; A41D 13/0012; A41D 13/0575; A41D 19/01552; A41D 2300/32; A41D 27/20; A45D 40/24; A45D 33/26; A45D 40/00; A45D 40/22; A45D 2034/002; A45D 33/00; A45D 33/008; A45D 33/32; A45D 34/00; A45D 42/04; A45D 42/06; A45D 42/10; A44C 5/0007; A44C 5/003
See application file for complete search history.

(56) References Cited

U.S. PATENT DOCUMENTS 468,149 A * 2/1892 Frank ..... A41D 19/002 2/160
825,510 A * 7/1906 Bloc et al. ..... A41D 19/002 2/160
1,154,122 A * 9/1915 Kovesy ..... A41D 19/002 2/160
1,458,436 A * 6/1923 Pameyer ..... B44D 3/02 224/148.7
1,613,664 A * 1/1927 Lewandowski ..... A41D 19/002 2/160
1,982,431 A * 11/1934 Hines ..... A41D 19/002 2/160
2,187,987 A * 1/1940 Sherrick ..... A63B 71/146 2/160
2,265,094 A * 12/1941 Wolfe ..... A45D 42/06 359/879

(Continued)

*Primary Examiner* — Robert H Muromoto, Jr.

(57) ABSTRACT

The composition of beauty gloves consist of gloves, a mirror, cosmetics and cosmetic brushes that are all integrated into a pair of gloves. Beauty gloves give the consumer the freedom of not carrying a handbag or beauty bag while still having the ability to carry a mirror, cosmetics and cosmetic brushes for makeup application almost anywhere. Beauty gloves can be worn while driving, bike riding and with most sports related activities. Prior to beauty gloves, in the current state of art, gloves are used independently as a fashion accessory for warmth and hand protection. Cosmetics, mirrors and makeup brushes are marketed independently or combined in a compact. The invention of beauty gloves integrates the three aforementioned components into one pair of gloves, that include a mirror, cosmetics and cosmetic brushes.

2 Claims, 13 Drawing Sheets

(56) References Cited

U.S. PATENT DOCUMENTS 2,428,477 A * 10/1947 Thompson ..... A41D 27/20 2/102
2,465,946 A * 3/1949 Velez ..... A45D 33/26 132/315
4,069,954 A * 1/1978 Rauch ..... A45F 5/00 224/219
D249,592 S * 9/1978 Libonati ..... 224/222
D258,246 S * 2/1981 Kravchenko ..... 224/222
4,326,706 A * 4/1982 Guthrie ..... A63B 21/065 2/160
4,330,120 A * 5/1982 Netti ..... A63B 21/065 2/160
4,504,980 A * 3/1985 Butcher ..... A41D 13/081 2/160
4,523,702 A * 6/1985 Viio ..... A45F 5/00 206/479
4,556,215 A * 12/1985 Tarbox ..... A63B 21/065 2/161.1
4,805,242 A * 2/1989 Bolton ..... A41D 19/002 2/160
4,907,729 A * 3/1990 Hess ..... A45C 1/04 224/240
4,957,231 A * 9/1990 Kalisher ..... A01K 97/06 224/240
5,088,121 A * 2/1992 Wallace ..... B65D 83/384 2/158
D329,926 S * 9/1992 Winder ..... D2/614
5,240,156 A * 8/1993 Sicotte ..... A41F 9/002 224/148.5
5,276,922 A * 1/1994 Floyd, Jr. ..... A41D 19/01594 2/160
5,309,328 A * 5/1994 Lum ..... A45F 5/00 2/170
5,341,972 A * 8/1994 Jacks ..... A45C 1/04 224/165
D359,154 S * 6/1995 Goodson ..... D29/113
5,444,874 A * 8/1995 Samelian ..... A41D 19/0013 2/159
5,588,571 A * 12/1996 Mazzo ..... A45C 1/04 150/136
5,657,201 A * 8/1997 Kochis ..... G06F 1/163 361/679.41
5,671,481 A * 9/1997 Giard ..... A41D 20/00 2/170
5,683,022 A * 11/1997 Evans ..... A41F 9/002 224/583
5,749,841 A * 5/1998 Moore ..... A41D 13/088 602/20
D397,837 S * 9/1998 Redwood ..... D2/614
5,820,526 A * 10/1998 Hoffman ..... A63B 21/065 482/55
5,833,095 A * 11/1998 Russell ..... A45F 5/02 224/576
5,881,734 A * 3/1999 Trayes ..... A45D 34/00 132/73
5,894,971 A * 4/1999 Huang ..... A45F 5/00 206/372
5,911,262 A * 6/1999 Steinhart ..... A45C 13/02 150/103
5,924,136 A * 7/1999 Ogean ..... A45C 1/04 2/159
6,227,424 B1 * 5/2001 Roegner ..... A45C 1/04 150/131
6,330,961 B1 * 12/2001 Borja ..... A45C 1/04 224/221
6,360,928 B1 * 3/2002 Russo ..... A45F 5/00 224/218
6,390,348 B1 * 5/2002 Godshaw ..... A45F 5/00 224/660
6,398,092 B1 * 6/2002 Ansley ..... A45F 5/02 224/582
6,425,137 B1 * 7/2002 Fakhrai ..... A45C 1/04 2/170
6,443,341 B1 * 9/2002 Rittmann ..... A45C 1/04 150/149
6,502,951 B2 * 1/2003 Marshall ..... A45C 13/02 362/154
6,913,176 B1 * 7/2005 Buscemi ..... A45F 5/00 224/665
7,048,162 B2 * 5/2006 Frye ..... A45D 29/20 206/373
7,222,629 B1 * 5/2007 Han ..... A41G 5/02 132/216
7,451,496 B2 * 11/2008 Carey ..... A41D 19/01529 2/160
7,644,448 B2 * 1/2010 Grilliot ..... A62B 17/003 2/161.6
8,156,571 B2 * 4/2012 Barzilla ..... A63B 71/143 2/19
8,413,842 B1 * 4/2013 Clou ..... E01H 1/1206 221/34
8,464,364 B2 * 6/2013 Hofeldt ..... A41D 19/01523 2/160
8,516,621 B2 * 8/2013 Woolery ..... A41D 13/0012 2/310
8,602,073 B2 * 12/2013 Swain ..... A45F 3/00 150/106
8,752,740 B2 * 6/2014 Morgan ..... A45F 5/00 224/222
8,776,268 B2 * 7/2014 Rodgers ..... A41D 19/002 2/160
9,066,571 B2 * 6/2015 Pflugfelder ..... A41D 19/0017
9,351,551 B2 * 5/2016 Morgan ..... A45F 5/00
9,386,815 B2 * 7/2016 Miller ..... A41D 19/0024
10,018,448 B2 * 7/2018 Klymenko ..... F41C 33/0209
10,080,397 B2 * 9/2018 Kelson ..... A45F 5/00
10,285,462 B2 * 5/2019 Charles ..... A41D 19/01535
10,299,546 B2 * 5/2019 Teal ..... B26B 29/04
10,327,527 B1 * 6/2019 Tyson ..... A45C 5/03
10,448,728 B1 * 10/2019 Gregory ..... A45C 11/22
2002/0067610 A1 * 6/2002 Marshall ..... A45C 13/02 362/156
2004/0064870 A1 * 4/2004 Gold ..... A41D 19/01 2/158
2004/0141314 A1 * 7/2004 Vautrin ..... A45C 15/06 362/156
2006/0011679 A1 * 1/2006 Santiago ..... B25H 3/00 224/222
2007/0028939 A1 * 2/2007 Mareri ..... A61Q 19/00 132/221
2010/0053941 A1 * 3/2010 Ibison ..... A45C 15/06 362/155
2010/0058979 A1 * 3/2010 Nakamura ..... A45D 33/26 118/200
2011/0061675 A1 * 3/2011 McKinley ..... A45D 33/24 132/296
2011/0072552 A1 * 3/2011 Johnson ..... A41D 19/002 2/160
2012/0241482 A1 * 9/2012 Mabika ..... A45C 13/02 224/148.4
2013/0062225 A1 * 3/2013 LaVaque ..... A45D 33/00 206/1.7
2013/0198932 A1 * 8/2013 Pflugfelder ..... A45D 44/00 2/160
2014/0116459 A1 * 5/2014 McKinstry ..... A45D 44/00 132/216
2016/0113387 A1 * 4/2016 Filho ..... A46B 5/04 134/6
2016/0183654 A1 * 6/2016 Leuty ..... A45C 3/06 362/155
2016/0198819 A1 * 7/2016 Grund ..... A45C 7/0054 132/288
2016/0324289 A1 * 11/2016 Dixon ..... A45D 19/0008
2016/0363806 A1 * 12/2016 Sinderbrand ..... A45C 13/00

* cited by examiner

BEAUTY GLOVES

BACKGROUND

Beauty gloves are gloves with backhand zip compartments that consist of a mirror, cosmetics and cosmetic brushes. The creation of the beauty glove integrates a glove, makeup and cosmetic applicators that make it convenient and compact to carry makeup for a touchup or just refreshing makeup. The current state of art for these three components exist individually and independently. Gloves, makeup and cosmetics applicators are generally carried separately inside a handbag, a clutch or a beauty bag. Beauty gloves forfill a void in the cosmetic and accessory industry by alleviating the need to always carry a bag with the contents of separate makeup, a mirror, and cosmetic applicators. Beauty gloves perform two functions, the first by containing a mirror, cosmetics and cosmetic applicators and the second is its original function of warming or protecting hands during active activities.

SUMMARY OF THE INVENTION

The beauty glove contains all three essential components necessary for makeup application, a mirror, cosmetics and cosmetic brushes. The invention of the beauty glove is designed to provide the active individual with the ability to apply makeup anywhere outdoors or inside. The beauty glove is comprised of a common fashion accessory, a pair gloves that encases a mirror, makeup and cosmetic brushes. The beauty glove alleviates the need to carry a cosmetic or beauty bag for basic makeup application. Beauty gloves are convenient and a compact way to carry cosmetics and cosmetic applicators.

DETAILED DESCRIPTION

Figure 1:
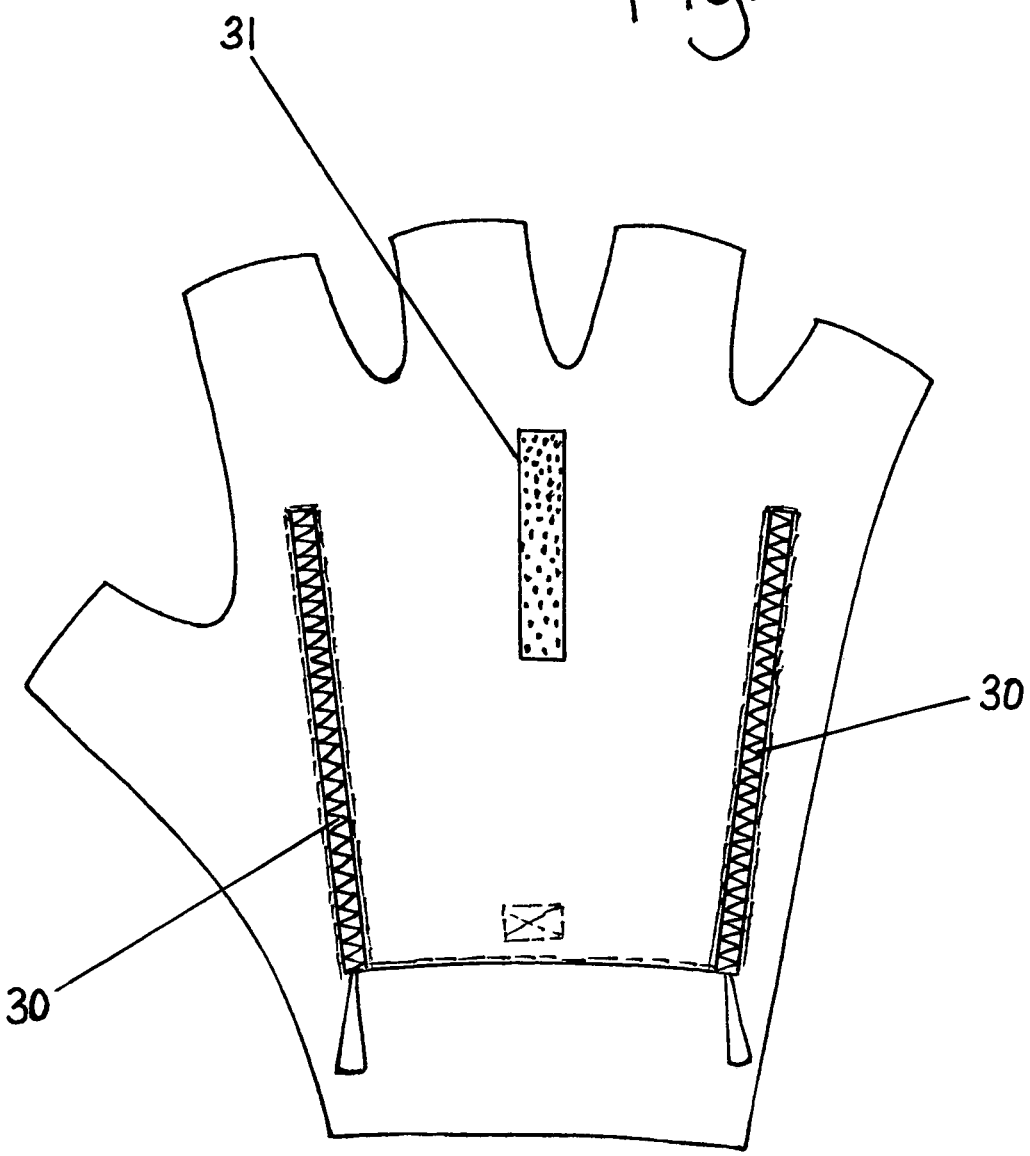
FIG. 1 drawing shows a front view of a fingerless beauty glove with right and left vertical zippers 30, closed. This drawing also shows velcro tape 31, on exterior back FIG. 2 drawing shows a right hand beauty glove zipped open exposing a makeup compact 32
Figure 2:
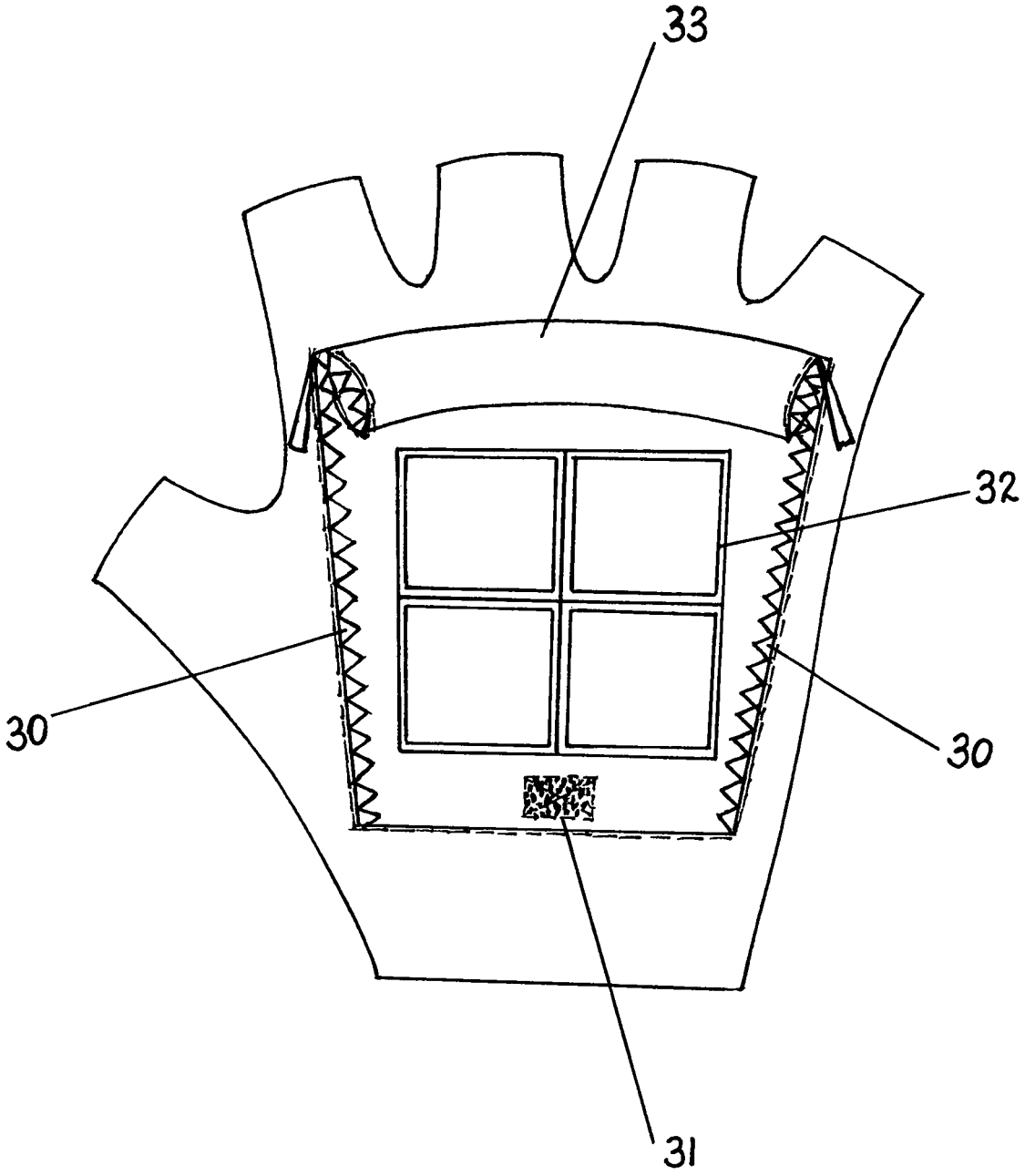
Figure 3:
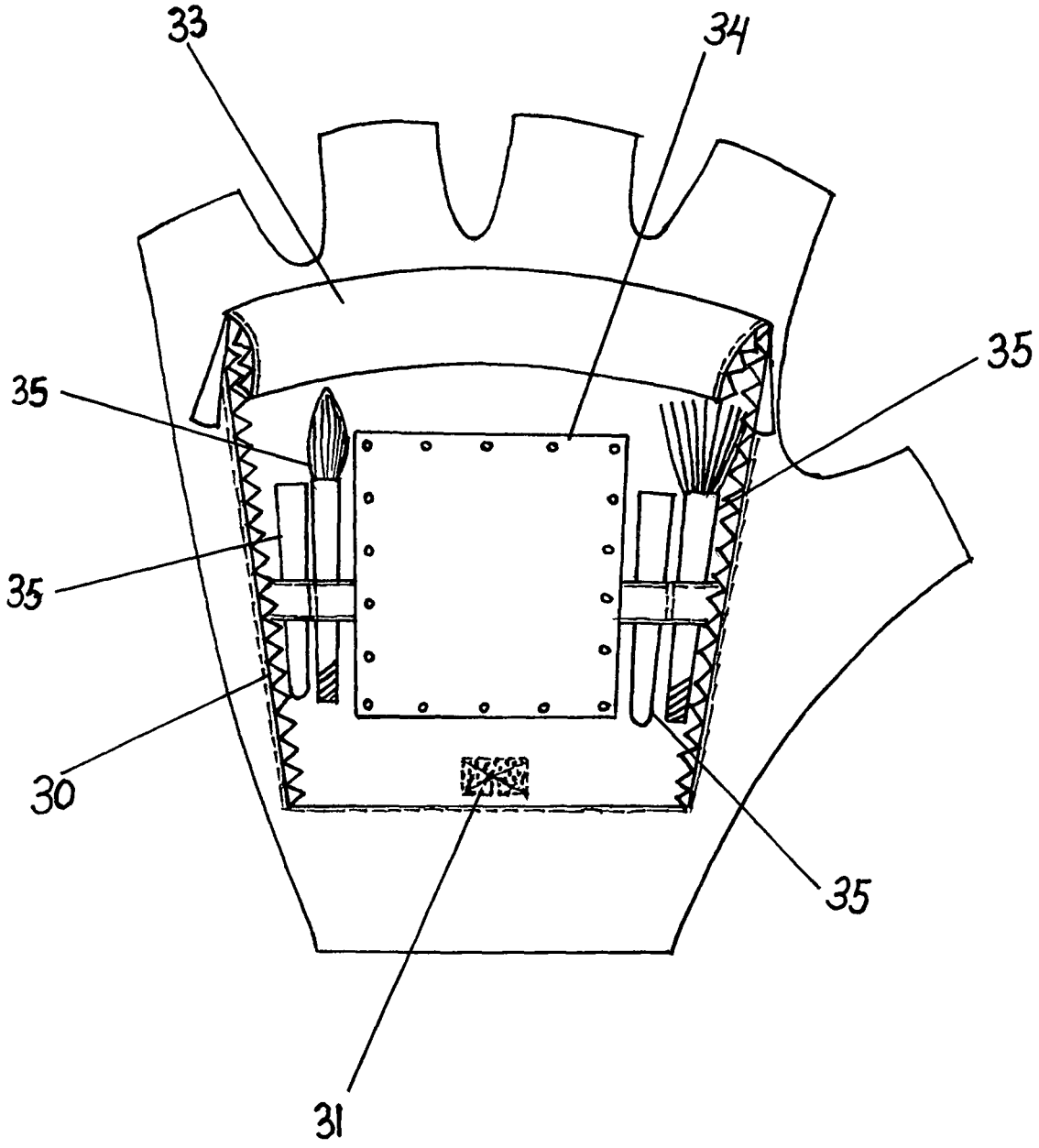
FIG. 3 drawing shows a left hand beauty glove zipped open revealing a lighted mirror 34, with four cosmetic brush segments 35, on right and left side of mirror FIG. 4 illustration shows a beauty glove zipped open with mirror and cosmetic brushes removed. This drawing also shows center circular stitches 36, that supports the hidden magnetic snap that holds mirror stationary. On the right and left sides are cosmetic brush holders 37
Figure 4:
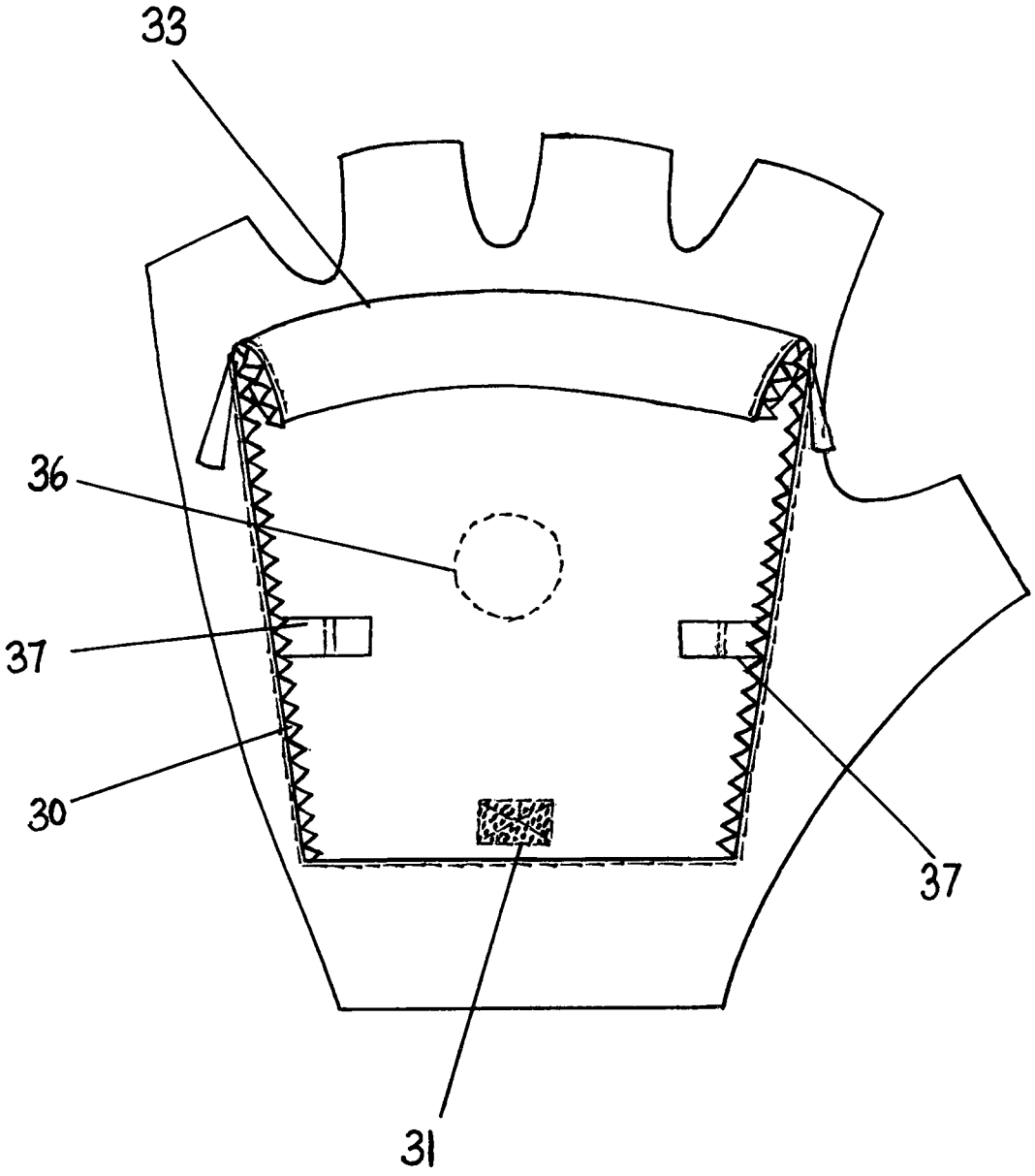
Figure 5:
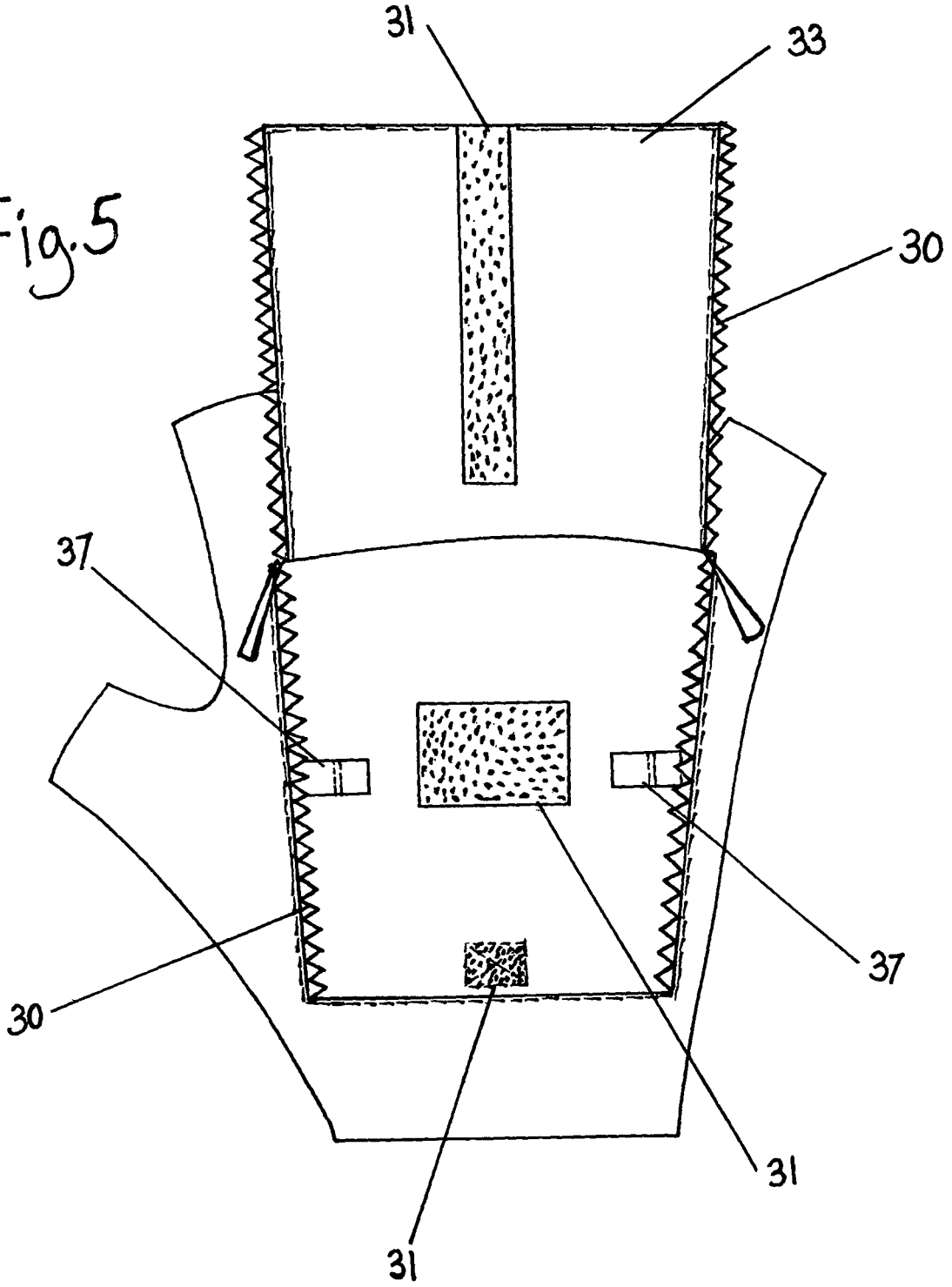
FIG. 5 this drawing shows a beauty glove zipped open with makeup compact and cosmetic brushes removed exposing center velcro tape 31, and velcro tape 31, on the underside of flap. This drawing also shows brush holders 37
Figure 6:
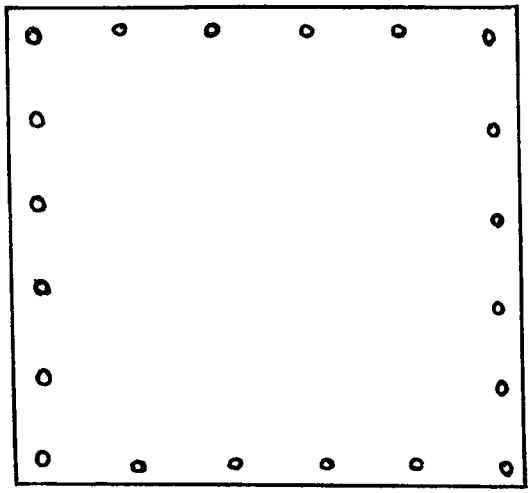
FIG. 6 drawing shows lighted mirror removed from beauty glove
Figure 7:
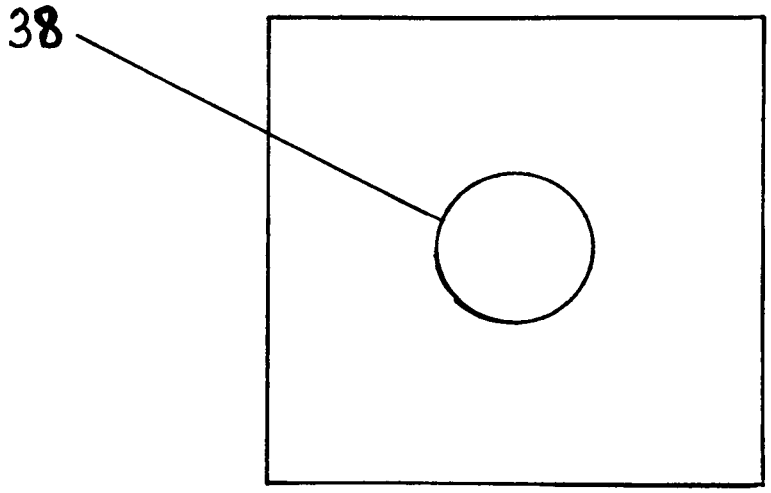
FIG. 7 drawing shows back view of mirror with a centered magnetic snap 38
Figure 8:
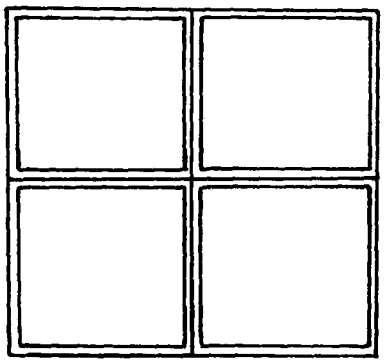
FIG. 8 drawing shows front view of makeup compact removed from beauty glove
Figure 9:
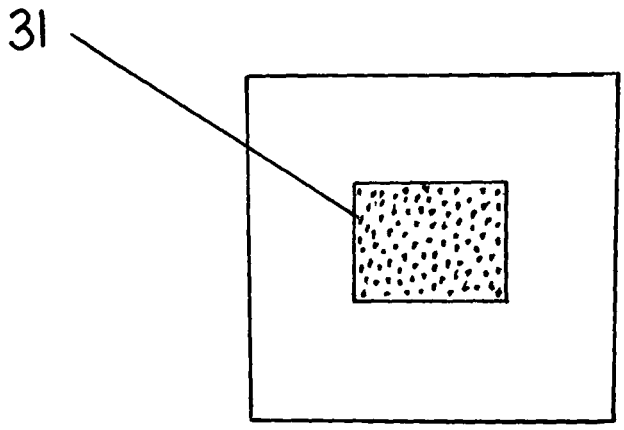
FIG. 9 sketch shows back view of makeup compact removed from beauty glove
Figure 10:
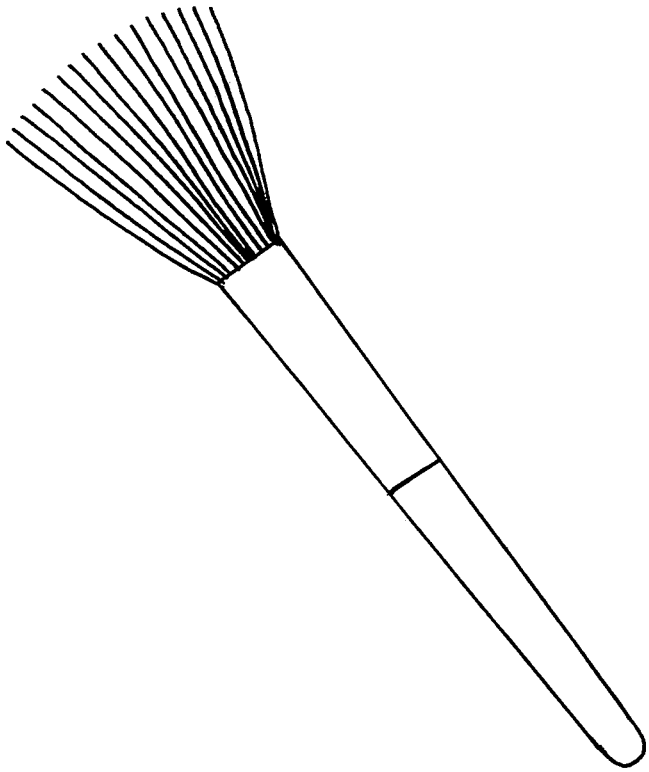
FIG. 10 drawing shows front view of an assembled blush brush removed from beauty glove FIG. 11 drawing shows front view of blush brush with two segments separated FIG. 12 this sketch shows front view of an assembled contour brush removed from beauty glove FIG. 13 drawing shows front view of a contour brush with two segments separated
Figure 11:
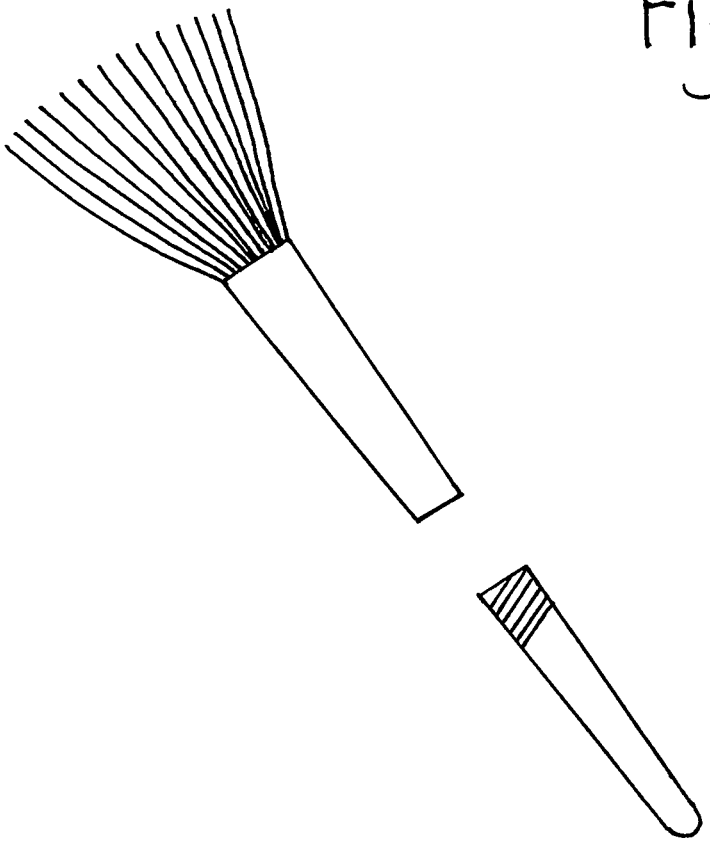
Figure 12:
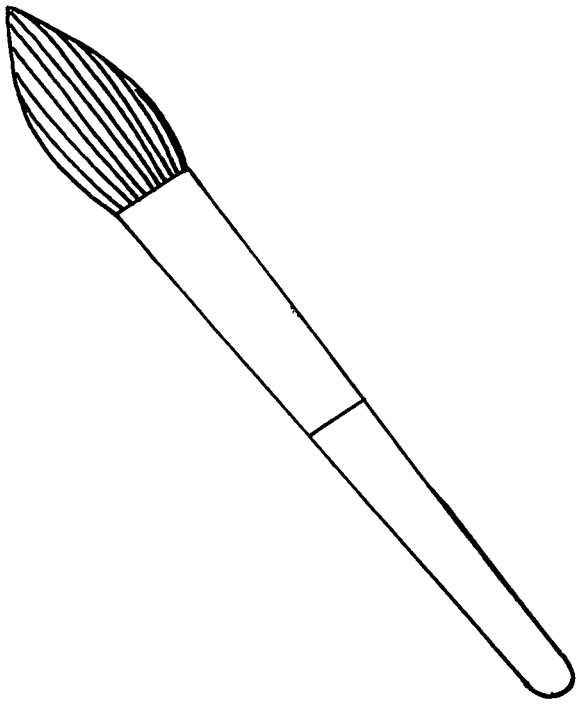
Figure 13:
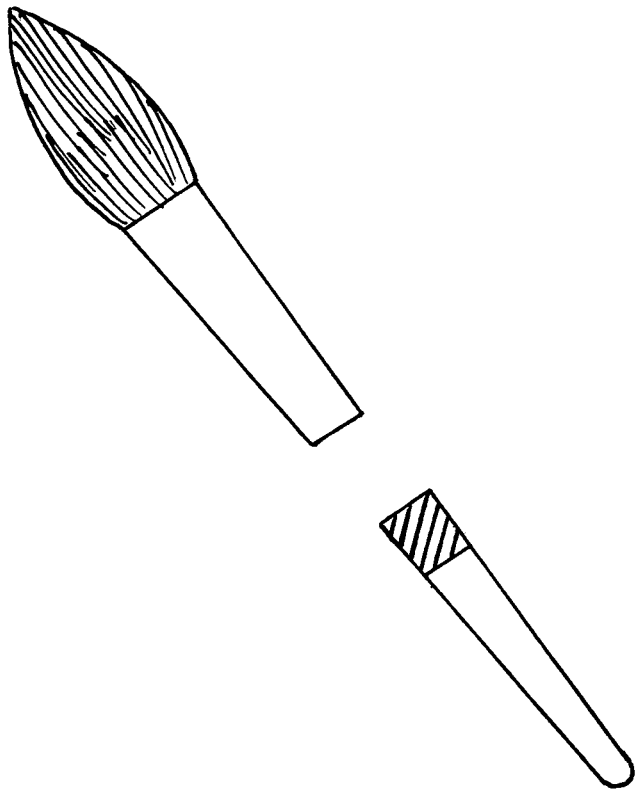

Beauty gloves are fingerless or fingered pair of gloves, comprised of a mirror, makeup compact and cosmetic brushes concealed in the back hand of gloves. There are two vertical zippers on the right and left back hand of the gloves. Once zipped open the contents of one glove has a miniature makeup compact attached with Velcro to the back of the glove. The second glove, when zipped open reveals a lighted or plain mirror attached to glove with a magnetic snap on the back. On the right and left side of the mirror are cosmetic brushes separated in two segments that can be assembled by screwing the parts together. Beauty gloves can be made of fabric material or leather. For the active individual, beauty gloves can minimize the need to carry a handbag or a cosmetic bag just for makeup application. Beauty gloves are ideal for refreshing makeup or a touchup. When zipped closed, there is a small Velcro tab at the center top of the horizontal wrist opening that supports closure. There is a strip of Velcro on the underside of the flap that holds the flap stationary when rolled back to access the mirror, cosmetics or cosmetic brushes. The makeup compact is replaceable. The mirror is detachable or attachable with a magnetic snap.

The invention claimed is:

1. A pair of gloves consisting of:

a selectively openable and closeable flap forming a storage compartment on dorsal portions of each of said gloves;

said flaps attached by hook and loop type fasteners and further including at least two vertical zippers on lateral edges of said flaps;

at least one glove of said pair of gloves includes a makeup compact and cosmetic brushes attached to the dorsal portion of said glove within the storage compartment;

the other glove of said pair of gloves includes a removable lighted or plain mirror attached with magnetic snaps to the dorsal portion of said other glove within the storage compartment.

2. A pair of gloves of claim 1 further consisting of:

at least one glove of said pair of gloves includes: two separated cosmetic brush segments compatible for assembly by screwing together;

said brush segments attached to the dorsal portion of said glove within the storage compartment.

* * * * *